US007726263B2

(12) United States Patent
Ben-Ishai

(10) Patent No.: US 7,726,263 B2
(45) Date of Patent: Jun. 1, 2010

(54) WATER HEATING AND STORAGE SYSTEM

(76) Inventor: Shmuel Ben-Ishai, 51 Ramat Mamreh, P.O. Box 2217, Kiryat Arbe 90100 (IL)

( * ) Notice: Subject to any disclaimer, the term of this patent is extended or adjusted under 35 U.S.C. 154(b) by 208 days.

(21) Appl. No.: 11/820,866

(22) Filed: Jun. 20, 2007

(65) Prior Publication Data

US 2008/0041363 A1 Feb. 21, 2008

(30) Foreign Application Priority Data

Jun. 21, 2006 (IL) ..... 176460

(51) Int. Cl.
*F24H 1/50* (2006.01)

(52) U.S. Cl. ..... 122/20 R; 122/20 A; 126/610; 392/447

(58) Field of Classification Search ..... 126/615, 126/611, 609, 641, 610; 122/20 R, 20 A, 122/497, 498, 499; 392/441, 444, 447
See application file for complete search history.

(56) References Cited

U.S. PATENT DOCUMENTS 1,425,174 A * 8/1922 Cartter et al. ..... 126/639
2,016,746 A * 10/1935 Ireland ..... 165/75
3,705,574 A * 12/1972 Duncan ..... 122/14.2
4,019,495 A * 4/1977 Frazier et al. ..... 126/588
4,207,866 A * 6/1980 Boyd ..... 126/588
4,237,862 A * 12/1980 Embree ..... 126/588
4,287,879 A * 9/1981 Roark ..... 126/591
4,384,568 A * 5/1983 Palmatier ..... 126/589
4,505,262 A * 3/1985 Eaton ..... 126/646
4,599,870 A * 7/1986 Hebert et al. ..... 62/238.6
5,072,717 A 12/1991 Laing et al.
5,103,802 A * 4/1992 Thomason ..... 126/610
5,203,500 A * 4/1993 Horne, Sr. ..... 237/19
5,758,820 A * 6/1998 Celorier et al. ..... 237/2 B
5,944,221 A 8/1999 Laing et al.
6,119,682 A 9/2000 Hazan
6,142,216 A * 11/2000 Lannes ..... 165/70
6,283,067 B1 * 9/2001 Akkala ..... 122/14.22
6,612,268 B1 * 9/2003 Peteri et al. ..... 122/19.2
2004/0237908 A1 12/2004 Nesser et al.

* cited by examiner

*Primary Examiner*—Gregory A Wilson
(74) *Attorney, Agent, or Firm*—Bachman & LaPointe, P.C.

(57) ABSTRACT

There is provided a water heating and storage system, including a heat-insulated main heated water storage tank for storing hot water. The storage tank consists of top, side and bottom walls, has an inlet for heated water entering the tank at a level below the normal level, and a cold water inlet. The system also includes a consumer hot water outlet, and an external water heater having a controlled electrical heating unit, an outlet port for heated water, connectable to the inlet of the tank, and a water inlet port.

13 Claims, 1 Drawing Sheet

WATER HEATING AND STORAGE SYSTEM

FIELD OF THE INVENTION

The present invention relates to a water heater. More particularly, the invention provides a water heating system including an improved electrically-powered water heater and a storage tank.

BACKGROUND OF THE INVENTION

Conventional solar water heater systems are usually comprised of a solar panel connected by pipes to a hot water storage tank for thermosyphonic circulation of water. The system has been proven to be simple to use and to be an impressive energy-saving device. In cold, cloudy weather, hot water is obtained by actuation of an electric heating element contained in the storage tank.

The main drawbacks of existing systems concern maintenance. The present arrangement is that at the base of the cylindrical insulated storage tank there is an opening of about 20 cm diameter which is closed by a flange held tightly by nuts, which in turn, are engaged with a set of firmly welded-on threaded studs. In the common vertical-axis tank, the flange is disposed at the bottom face of the tank. The flange supports the electric heater element and a thermostat, both of which project into the water storage tank. The joint between the flange and the opening is a well-known region for the start of corrosion and eventual leakage. Maintenance activities such as cleaning of built-up scale and accessing the electrical connections in the available restricted space are difficult, and are all the more difficult for changing the flange and/or thermostat, since before any action is possible, all the contents of the storage tank must be drained out, thereby wasting between tens and hundreds of liters of water. Thus, a simple maintenance task such as removing scale, replacing a burnt-out electric element, etc., requires much time and effort.

To ensure the availability of hot water in a plumbing system, several devices have been patented. In U.S. Pat. No. 5,072,717, to Laing et al, there is disclosed a priming device upstream from a hot water tap for storing a small amount of water at a continuously maintained temperature. When the tap is opened, the stored water is delivered out of the faucet, while the cold water that has been stationary in the hot water pipe, is fed into the priming device. Similarly, U.S. Pat. No. 5,944,221 to Laing et al, teaches a system of a water heater, a tank and a pump for pre-storing an amount of hot water that is delivered upon demand through a hot water faucet while the equal amount of cold water is pumped into the tank.

The above systems do provide hot water on demand until the water from the hot water pipe arrives at a necessary temperature, however, these devices do not render themselves useful for service in solar-radiation water heating systems, since the devices are not capable of continuous operation required to compensate for the cooling effects of wintry, cloudy weather on the water in the hot water storage tank. Moreover, the system is greatly encumbered by the incorporation of valves and pumps.

To keep large amounts of hot water available to consumers, U.S. Patent Application No. 2004/0237908 teaches a system composed of a water heater tank and a supplemental tank. The supplemental tank is used to store hot water available for immediate delivery through a hot water faucet. The system, however, fails to be applicable in the solar-radiation water heating systems, because the system fails to address the drawbacks of the solar panels.

In U.S. Pat. No. 6,119,682 to Hazan, there is described and claimed a water heater and storage device containing a solar panel and a tank, which further has a heat exchanger piping circuit to facilitate the transfer of heat from the water stored in the tank to cold line-pressure water. An electrical water heating element is disposed in the general proximity to the heat exchanger. The system disclosed in this patent aims to provide a more economical heating of cold water. The design of the system renders the water tank filled unnecessarily with complicated pipe-work of the heat exchanger disposed too close to the heating element In contradistinction to the above prior art systems, the present invention achieves higher energy savings and efficiency by means of an external water heater, and provides for an extremely simple, easy to service system.

It is known in practice that heating elements working continuously in non-distilled water become coated with a deleterious layer of insoluble mineral deposits. In common water heater construction, all the more so in the solar panel systems, to change a thermostat or the heating element calls for work performed in awkward, obstructed spaces, and also calls for draining large amounts of water from the water heater being serviced.

SUMMARY OF THE INVENTION

It is therefore one of the objects of the present invention to obviate the disadvantages of prior art water heaters and to provide a water heater and a solar-radiation water heater which can be serviced in an easier manner, without the necessity of draining the water in the storage tank.

It is a further object of the present invention to extend the operating life of the storage tank by eliminating the large opening, the welded-on studs and the flange commonly found on prior art storage tanks.

In a further preferred embodiment of the present invention there is provided a water heating and storage system wherein the base of the external tank is detachably affixed into the bottom edge of the side walls for easy cleaning of built-up scale in the interior of the water heater tank.

In still a further preferred embodiment of the present invention there is provided a water heating and storage system wherein the water inlet of the water heater tank is connectable to an outlet of a solar collector.

In another preferred embodiment of the present invention there is provided a water heating and storage system wherein the storage tank is a part of an existing water heating system wherein the storage tank is connected directly to the solar collector of the existing system, and the external water heater is installed within the existing system such that the water inlet of the water heater is connected to the outlet of the solar collector, and a hot water outlet of the external water heater is connected to the storage tank of the existing system.

The present invention achieves the above objects by providing a water heating and storage system, comprising a heat-insulated main heated water storage tank for storing hot water, said storage tank consisting of top, side and bottom walls, said storage tank having an inlet for heated water entering the tank at a level below the normal level, a cold water inlet, and a consumer hot water outlet, and an external water heater including a controlled electrical heating unit, an outlet port for heated water, said outlet port being connectable to the inlet of said tank, and a water inlet port.

The present invention also provides a water heater for operationally interconnecting with a hot water storage tank comprising an enclosure having a top, side and bottom walls enclosing a volume for containing about 1 to 3 liters, and a water heating arrangement at the top of side walls of the enclosure for controllably heating water inside said enclosure, wherein said bottom wall being detachably attached to said side walls, facilitating access to the interior of the enclosure.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic view of a preferred embodiment of the water heating and storage system, according to the present invention;

FIG. 2 is a detailed schematic view to an enlarged scale of an external water heater, according to the present invention, and FIG. 3 is a schematic view of a preferred embodiment of the water heating and storage system, inter-connected with a solar collector panel.

DETAILED DESCRIPTION OF PREFERRED EMBODIMENTS

Figure 1:
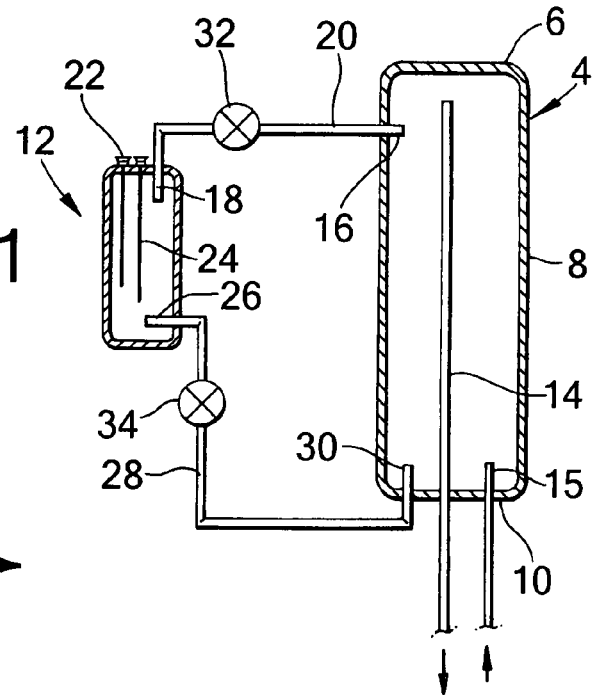

There is seen in FIG. 1 a water heating and storage system 2 composed of a thermally insulated, hot water storage tank 4, e.g., a cylindrical tank, having a top 6, a side wall 8, a bottom or base 10 and an external water heater 12. The tank 4 has a pipe 14 for delivering hot water to a consumer, typically reaching at one end adjacent to the top 6 and exiting the base 10, and a cold water inlet 15. There is also provided at the upper portion of the tank 4 a heated water inlet 16. Advantageously, the water heater 12 is cylindrically shaped and has a capacity typically of 1 to 3 liters and includes heated water outlet port 18 leading through pipe 20 to the inlet 16 of the tank 4.

The external water heater 12 is also provided with an electrical heating element 22, and advantageously, a thermostat 24 both attached to the upper wall of the heater, and a water inlet port 26 at the lower end portion thereof. The inlet port 26 is interconnected by a pipe 28 with a water outlet 30 of the tank 4. There are also provided valves 32 and 34 fitted in pipes 20 and 28, respectively.

Figure 2:
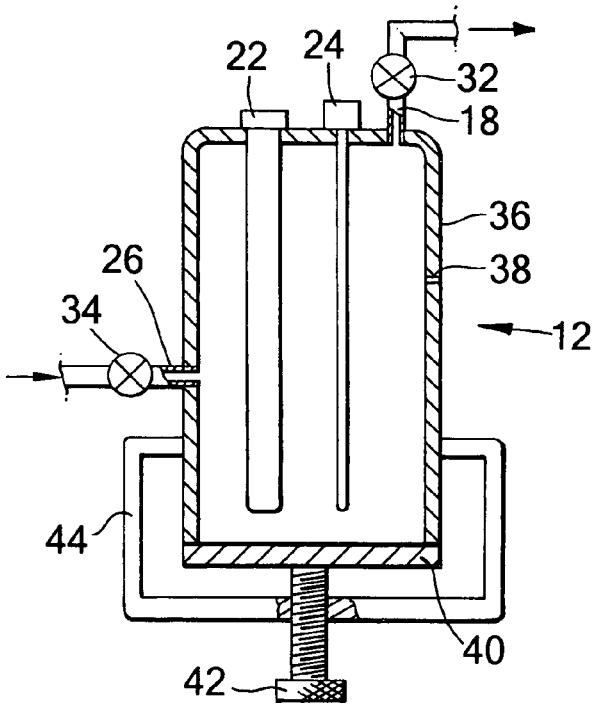

Referring now to FIG. 2, there is seen a water heater 12 having a thermo-insulating double-walled jacket 36, the space 38 between the double walls may be filled with insulating material or be utilized for circulating hot water for heating the water inside the heater, as per se known. One of the most practical features of the water heating system according to one embodiment of the invention, is the construction of the heater 12 which has a removable bottom lid 40, which is held water-tight onto the jacket 36 of the main body of the heater 12, by a screw 42 passing through a thread in a frame 44 attached to the jacket 36. The outlet and inlet ports 18 and 26 are fitted with valves 32 and 34, respectively, for preventing water flow into the heater or water draining from the heater when the heater is opened while still installed. When the heater must be opened for servicing, such as for draining or otherwise removing any mineral sediments, cleaning scale built-up on the heating element 22 and the inner walls of the heater, or changing either of the thermostat 24 or the heating element 22, the liquid communication to and from the heater 12 is cut off using valves 32 and 34. The bottom lid 40 is conveniently unscrewed and any water contained in the external tank 12 is drained. Due to the small capacity of the water heater 12, during the opening of the bottom lid 40, only a minimal amount of water is spilled, unlike the copious amounts of water spilled when the flanged sleeve nuts are loosened on the water heater tanks in the prior art. Yet another advantage is in the compactness of the water heater 12, rendering same simple and quick to install into the existing, old solar panel collector heating systems. This case would typically call for removal of the flanged sleeve supporting the old heating element and thermostat, sealing the existing water heating tank, thereby converting the existing main storage tank into the tank 4. In one embodiment of the invention, the heating element and the thermostat, if both relatively clean, or having been cleaned of mineral scale, can be removed from an existing deployed water storage tank and installed in the water heater 12, thus easily forming the system of the invention by retrofit.

Figure 3:
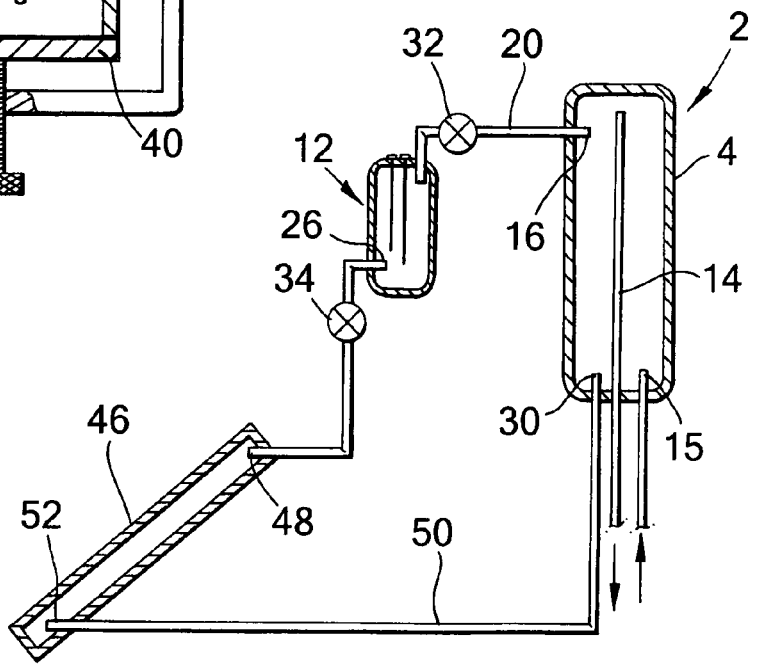

There is seen in FIG. 3 a water heating and storage system 2 including one or more solar collectors 46, typically containing water pipes or channels for absorbing solar radiation, thermally insulated hot water storage tank 4 and a water heater 12. The inlet port 26 of the heater 12 is connectable via the valve 34 to an outlet 48 of the collector 46. The water storage tank 4 is connected via outlet 30 and pipe 50 to the inlet 52 of the solar collector 46 for allowing the water stored in the storage tank 4 to flow to the solar collector 46, in order to complete the thermosyphonic path. The storage tank 4 is also connectable to a cold water inlet 15 for introducing cold water from the main water supply.

It will thus be realized that the novel device of the present invention serves to:

a) provide a system for a fast, economical heating and storing of hot water, without the need for a sleeve inside the storage tank;

b) provide compact, easily serviceable electrical components of the system;

c) facilitate easy and unobstructed access to the components of the system;

d) provide a longer lasting storage tank not requiring either an internal sleeve or a flange opening, and e) avoid freezing of the water in solar collectors during cold weather by causing warm water from the heater to circulate through the collectors.

While some of the advantages of the present invention can be realized in retrofit applications, and a retrofit kit would be a profitable product, nevertheless it will be understood that maximum benefits are obtained when the main water tank is replaced. The idea of replacement of the prior-art main storage tank by a new longer-lasting main storage tank costing less than the cost of the present day tank will be attractive to consumers. The new tank will have an extended life due to elimination of the rust-inducing flange, flange opening and welded-on studs. Insulation will be improved and simplified as no access flange is required.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A thermosyphonic water heating and storage system, comprising:

a heat-insulated main heated water storage tank for storing hot water, said storage tank having top, side and bottom walls;

said storage tank having a hot water inlet close to the top wall of the tank for heated water entering the tank, a cold water inlet, and a consumer hot water outlet;

an external water heater of a capacity up to several liters and having top and side walls and a base, a controlled electrical heating unit protruding into an interior of said water heater from the top wall thereof, an outlet port for heated water, said outlet port being connectable to the inlet of said tank and a water inlet port;

a first valve connected between the a non-consumer outlet of the storage tank and the water inlet port of the external water heater for allowing prevention of water flow from the storage tank to the external water heater during maintenance;

a second valve connected between the hot water inlet of the storage tank and the outlet of the external water heater for allowing prevention of hot water flow from the storage tank to the external water heater during maintenance; and said base being detachably affixed on to said side walls for easy maintenance of the external water heater including maintenance and replacement of the electrical heating unit.

2. The system according to claim 1, wherein the water inlet port of said water heater is connected to an outlet of a solar collector.

3. The system according to claim 2, wherein said solar collector has a water inlet connected to an outlet at, or adjacent to, the bottom wall of said storage tank.

4. The system according to claim 3, wherein said storage tank further comprises a cold water inlet.

5. The system according to claim 1, further comprising a valve fitted on the outlet port of said heater.

6. The system according to claim 1, wherein said storage tank is a part of an existing system and a solar collector, and said external water heater is operationally installed within said existing system such that the water inlet port of said water heater is connected to the outlet of said solar collector, and a hot water outlet port of said external water heater is connected to the storage tank of said existing system.

7. The system according to claim 1, wherein said storage tank is a part of an existing water heating system, and said external water heater is operationally installed within said existing system such that the water inlet port of said water heater is connected to the outlet of said storage tank at the bottom portion thereof, and a hot water outlet port of said external water heater is connected to an inlet of said water tank at the top portion thereof.

8. A water heater for operationally interconnecting with a hot water storage tank in a thermosyphonic water heating and storage system, the water heater comprising:

an enclosure having a top, side and bottom walls enclosing a volume for containing about 1 to 3 liters;

a water heating arrangement at the top of side walls of the enclosure for controllably heating water inside said enclosure;

wherein said bottom wall is detachably attached to said side walls, facilitating access to an interior of the enclosure for facilitating maintenance and replacement of the electrical heating arrangement, and wherein said water heating arrangement includes an electrical heating element.

9. The water heater as claimed in claim 8, wherein said enclosure is cylindrical in shape.

10. The water heater as claimed in claim 8, wherein said water heating arrangement includes a double wall constituting the side walls of said enclosure.

11. A method for fluidically separating heating and storage faculties of a thermosyphonic water heating and storage system having a storage tank coupled to an external water heater having a controlled electrical heating unit to facilitate maintenance including replacement of the electrical heating unit without requiring emptying of the storage tank, the method comprising:

providing the external water heater with a small capacity tank up to several liters having top and side walls and a removable base;

coupling an outlet of the external water heater to an inlet of the storage tank via a first valve;

coupling an inlet of the external water heater to a water outlet port of said storage tank via a second valve; and prior to maintenance, closing the first and second valves so as to prevent the inlet of water to the external water heater from the storage tank, detaching said base and allowing water to drain from the small capacity tank.

12. The method as claimed in claim 11, further comprising coupling the water inlet port to a hot water outlet of a solar panel.

13. The method as claimed in claim 12, further comprising energizing the electrical heating unit during cold ambient temperatures so as to ensure a constant flow of water through the solar panel and thereby prevent freezing of water inside the solar panel.

* * * * *